US008353272B2

(12) United States Patent
Scheffel

(10) Patent No.: US 8,353,272 B2
(45) Date of Patent: Jan. 15, 2013

(54) FUEL INJECTION SYSTEM WITH COMPENSATION ELEMENT

(75) Inventor: Martin Scheffel, Vaihingen (DE)

(73) Assignee: Robert Bosch GmbH, Stuttgart (DE)

( * ) Notice: Subject to any disclaimer, the term of this patent is extended or adjusted under 35 U.S.C. 154(b) by 372 days.

(21) Appl. No.: 12/670,048

(22) PCT Filed: Jun. 24, 2008

(86) PCT No.: PCT/EP2008/057996

§ 371 (c)(1),
(2), (4) Date: Jan. 21, 2010

(87) PCT Pub. No.: WO2009/015948

PCT Pub. Date: Feb. 5, 2009

(65) Prior Publication Data

US 2010/0186717 A1 Jul. 29, 2010

(30) Foreign Application Priority Data

Jul. 30, 2007 (DE) ..... 10 2007 035 714

(51) Int. Cl.
*F02M 61/14* (2006.01)
*F16J 15/34* (2006.01)
*F02F 11/00* (2006.01)

(52) U.S. Cl. ..... 123/470; 277/470; 277/596

(58) Field of Classification Search ..... 123/468, 123/470; 277/407, 594, 596
See application file for complete search history.

(56) References Cited

U.S. PATENT DOCUMENTS 5,954,343 A * 9/1999 Sumida et al. ..... 277/434
6,196,195 B1 3/2001 Trutschel et al.
6,431,151 B1 8/2002 Gmelin
6,684,861 B2 * 2/2004 Reiter ..... 123/470
6,718,949 B2 * 4/2004 Gmelin ..... 123/470
8,069,842 B2 * 12/2011 Kannan ..... 123/470
2003/0145831 A1 8/2003 Liskow
2003/0164158 A1 * 9/2003 Reiter ..... 123/470
2004/0020470 A1 * 2/2004 Norgauer ..... 123/470
2004/0089270 A1 5/2004 Scheffel (Continued)

FOREIGN PATENT DOCUMENTS

DE 19725076 A1 12/1998

(Continued)

*Primary Examiner* — Stephen K Cronin
*Assistant Examiner* — Sherman Manley
(74) *Attorney, Agent, or Firm* — Maginot, Moore & Beck

(57) ABSTRACT

The present invention relates to a fuel injection system for the direct injection of fuel into a combustion chamber of an internal combustion engine. At least one fuel injection valve is arranged on a cylinder head in a receiving bore in order to inject fuel into the combustion chamber. A fuel distribution line is provided for feeding the fuel to the fuel injection valve. A compensation element for a position compensation and/or tolerance compensation, is arranged in the radial direction between the fuel injection valve and the cylinder head and is arranged in the axial direction of the fuel injection valve between a first sealing element, sealing between the fuel injection valve and the cylinder head on a side facing the combustion chamber of the fuel injection valve, and a second sealing element, sealing between the fuel injection valve and the fuel distribution line. Further provided is a support ring, which is arranged between the fuel injection valve and the cylinder head and which provides support for the fuel injection valve in the axial direction on a step of the receiving bore and which has a clearance in the radial direction.

20 Claims, 3 Drawing Sheets

U.S. PATENT DOCUMENTS

| | | | | |
|---|---|---|---|---|
| 2004/0194760 | A1 | 10/2004 | Streb et al. | |
| 2004/0194764 | A1 | 10/2004 | Okajima et al. | |
| 2006/0065245 | A1 * | 3/2006 | Kawamoto et al. | 123/470 |
| 2007/0175451 | A1 * | 8/2007 | Beardmore | 123/470 |
| 2007/0228662 | A1 * | 10/2007 | Reiter et al. | 277/313 |
| 2009/0050113 | A1 * | 2/2009 | Liskow | 123/470 |

FOREIGN PATENT DOCUMENTS

| | | | |
|---|---|---|---|
| DE | 19735665 | A1 | 1/1999 |
| DE | 19743103 | A1 | 4/1999 |
| DE | 10158787 | A1 | 6/2003 |
| DE | 10158788 | A1 | 6/2003 |
| DE | 10140797 | A1 | 7/2003 |
| DE | 10163030 | A1 | 7/2003 |
| DE | 10334118 | A1 | 3/2004 |
| WO | 0238943 | A2 | 5/2002 |
| WO | 02066825 | A1 | 8/2002 |
| WO | WO 2005021956 | A1 * | 3/2005 |
| WO | WO 2006097374 | A1 * | 9/2006 |

* cited by examiner

II-II

FUEL INJECTION SYSTEM WITH COMPENSATION ELEMENT

CROSS-REFERENCE TO RELATED APPLICATION

This application is a 35 USC 371 application of PCT/EP2008/057996 filed on Jun. 24, 2008.

BACKGROUND OF THE INVENTION

1. Field of the Invention

The present invention relates to a fuel injection system for direct injection of fuel into a combustion chamber of an internal combustion engine.

2. Desciption of the Prior Art

Various embodiments of fuel injection systems are known from the prior art. For example, from German Patent Disclosure DE 101 40 797 A1, a fuel injection valve is known which has a compensation element for supporting the fuel injection valve in a cylinder head. The compensation element has lands on a ring that extend along a valve housing and on the end of which support segments are disposed. The support segments are embodied in the form of part of a circle, in order to ensure spacing apart between the fuel injection valve and the receiving bore in the cylinder head.

ADVANTAGES AND SUMMARY OF THE INVENTION

The fuel injection system according to the invention for direct injection of fuel into a combustion chamber of an internal combustion engine has the advantage over the prior art that it enables a floating support of a fuel distributor line, such as a rail. The fuel injection system is constructed quite simply and can be furnished especially economically. In particular, the fuel injection system can compensate for tolerances between a fuel distributor line, the cylinder head, and the fuel injection valve and can ensure optimal positioning of the fuel injection valve in a receiving bore of the cylinder head. The injection system of the invention includes a compensation element for positional compensation and/or tolerance compensation, and a separate bracing element. The bracing element is disposed between the fuel injection valve and the cylinder head on a step of the receiving bore and has a play in the radial direction. The bracing element ensures bracing of the fuel injection valve in the axial direction of the fuel injection valve. The compensation element is disposed in the axial direction of the fuel injection valve between a first sealing element and a second sealing element. The first sealing element seals off between the fuel injection valve and the cylinder head, and the second sealing element seals off between the fuel injection valve and the fuel distributor line. By the combination according to the invention of the compensation element with the separate support element with radial play, a secure tolerance compensation can be made possible, and in a compensation event, the second seal is intended as a pivot point. This is possible because of the radial play of the bracing element. It should also be noted that it is understood that a plurality of fuel injection valves may also be provided, and the engine can also include a plurality of cylinders.

Preferably, the compensation element is a sleeve with a fixation region and a plurality of elastic elements. The sleeve is provided in annular form and on an annular fixation region has a plurality of elastic elements. Preferably, the elastic elements are embodied as at least three radially outward-protruding hooks or lugs.

In an alternative embodiment of the present invention, the compensation element is a wave ring. The wave ring has a sinusoidal course, for instance, with protruding and recessed turning points that are arranged around an imaginary circle in order to form the ring.

In another preferred feature of the present invention, the compensation element includes a disk element, with a disk region and a collar disposed in the receiving bore in the cylinder head. The collar has a predetermined elasticity and is in contact with the fuel injection valve, which makes the positional and tolerance compensation possible.

In still another preferred feature of the present invention, the compensation element includes a plurality of ribs that are oriented in the axial direction of the fuel injection valve. The ribs are disposed between the fuel injection valve and the cylinder head, and they have an elasticity in order to make the compensation function possible. Preferably, the ribs are integrally injection-molded on the fuel injection valve or on the receiving bore in the cylinder head.

Especially preferably, the ribs are disposed on the fuel injection valve, and a play is provided between the ribs and the receiving bore in the cylinder head. The ribs may for instance be injection-molded in one piece with a housing component of the fuel injection valve.

Preferably, the compensation element is made from an elastic plastic or a sheet-metal material, in particular a spring sheet metal.

To ensure the greatest possible capability of a tolerance compensation, the compensation element is preferably disposed as close as possible to the first sealing element. Especially preferably, the first sealing element and the compensation element are disposed immediately adjacent one another, and contact between the two components is also possible. Especially preferably, the compensation element is disposed directly at the beginning of the receiving bore for the fuel injection valve in the cylinder head.

For especially great compensation for tolerances, a fixation with play in the radial direction on the cylinder head is preferably possible on a fixation element, such as a rail cup, that is provided on the cylinder head for fixation of the fuel distributor line. For the purpose of fixation, bores with a large diameter that make the radial play possible are for instance provided on the fixation element.

Especially preferably, the second sealing element is embodied as a Teflon ring. As a result, on the one hand the scaling function between the fuel injection valve and the receiving bore in the cylinder head can been ensured, and on the other, the Teflon ring can be securely used as a pivot point for a tolerance compensation without being damaged.

The fuel injection system of the invention can be used in both Otto engines and in Diesel engines. Especially the possibility, in multi-cylinder engines, of an unfavorable addition of production-caused tolerances or assembly tolerances can be compensated for in excellent fashion by the fuel injection system according to the invention.

BRIFF DESCRIPTION OF THE DRAWINGS

Below, preferred exemplary embodiments of the invention will be described in detail in conjunction with the accompanying drawings. In the drawings.

DESCRIPTION OF THE PREFERRED EMBODIMENTS

Figure 1:
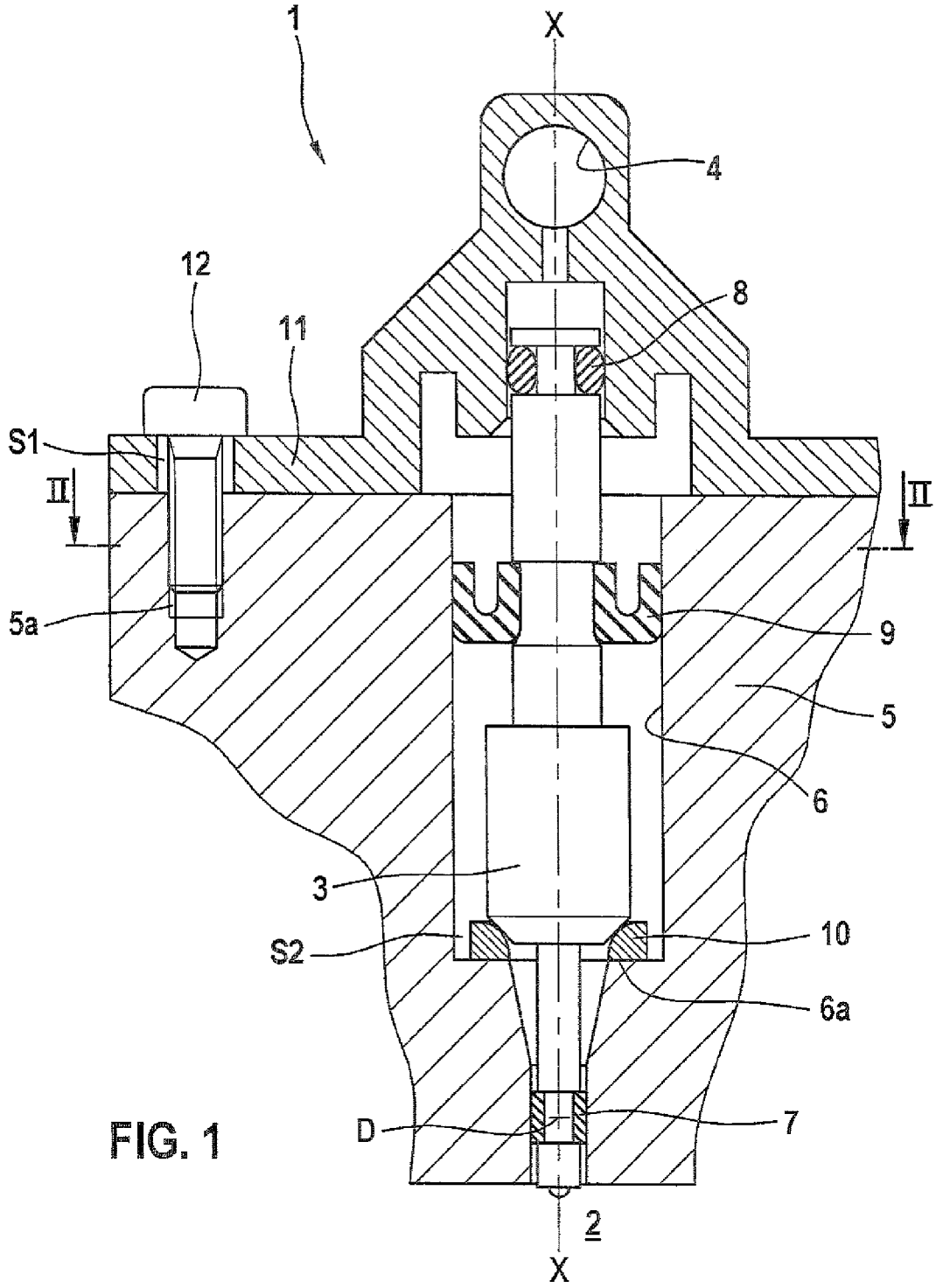
FIG. 1 is a schematic sectional view of a fuel injection system in a first exemplary embodiment of the invention.

Below, with reference to FIGS. 1 and 2, a fuel injection system 1 in a first exemplary embodiment of the invention will be described. As can be seen from FIG. 1, the fuel injection system 1 includes a fuel injection valve 3, which injects fuel into a combustion chamber 2. The fuel injection valve 3 communicates with a fuel distributor line 4, such as a rail. The fuel distributor line 4 distributes a fuel, for instance Diesel fuel, that is under pressure to the fuel injection valves that are present. The fuel injection system 3 is disposed in a cylinder head 5 in a receiving bore 6. The fuel distributor line 4 is also secured to a distributor line cup 11 by means of a screw 12 in a threaded bore 5*a* of the cylinder head 5. A play S1 is provided between the screw 12 and the distributor line cup 11.

The fuel injection system 1 further includes a first sealing element 7, a second sealing element 8, a compensation element 9, and a bracing ring 10. The first sealing element 7 seals between the fuel injection valve 3 and the cylinder head 5, on an end of the fuel injection valve 3 oriented toward the combustion chamber 2. The second sealing element 8 seals between the fuel injection valve 3 and the fuel distributor line 4, on an end of the fuel injection valve 3 oriented toward the fuel distributor line 4. The bracing ring 10 supports the fuel injection valve 3 in the axial direction X-X of the fuel injection valve on a step 6*a* of the receiving bore 6. Between the bracing ring 10 and the receiving bore 6, there is a play S2. The compensation element 9 is disposed on the fuel injection valve 3 in a region between the first sealing element 7 and the second sealing element 8, or more precisely in a region between the bracing ring 10 and the second sealing element 8.

Figure 2:
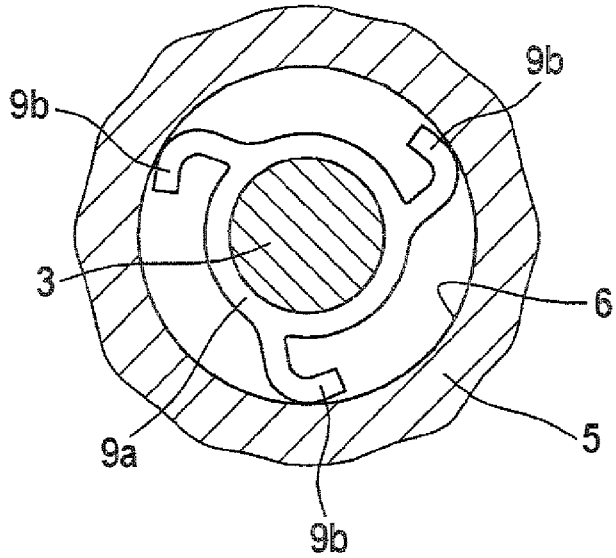
FIG. 2 is a schematic sectional view along the line II-II of FIG. 1, with a top view on a compensation element of the first exemplary embodiment.

The compensation element 9 can be seen in detail in FIG. 2. As shown in FIG. 2, the compensation element 9 includes an annular fixation region 9*a*, with which the compensation element is secured to the fuel injection valve 3, and a plurality of elastic elements 9*b*, which are formed in one piece with the annular fixation element 9*a*. In this exemplary embodiment, the elastic elements 9b are three outward-protruding hook elements. The elastic elements 9*b* are in contact with the receiving bore 6 and enable a resilient bracing of the fuel injection valve 3 in the radial direction.

If in the assembled state stress were to occur because of production-dictated tolerances or assembly tolerances of the various individual components of the fuel injection system 1, it can be compensated for now by the arrangement of components according to the invention. Because of the play S2 of the fuel injection valve 3 in the region of the bracing ring 10 and the play Si in the fastening of the distributor line cup 11 to the cylinder head 5, the fuel injection system 3 can rotate about a pivot point D, which is located in the vicinity of the first sealing element 7. Depending on existing stresses, a deformation occurs at the elastic elements 9b of the compensation element 9. Because the compensation element 9 is disposed in the vicinity of the fuel injection valve 3, tolerances in all directions can be compensated for. It is preferred that the compensation element 9 be disposed as close as possible to the edge of the receiving bore 6. Especially preferably, an upper face of the compensation element 9 is flush with a surface of the cylinder head 5. The bracing ring 10 furthermore supports the fuel injection valve 3 in the axial direction X-X, but because of the play S2, it also makes the rotation of the fuel injection valve 3 about the pivot point D possible for the sake of positional and tolerance compensation. Since separate sealing elements 7, 8 are used for sealing the fuel injection valve 3, the tightness at the fuel injection valve 3 can continue to be ensured without problems. To enable withstanding the highest possible loads, the first sealing element 7 is preferably a Teflon ring, with a predetermined height in the axial direction. According to the invention, the fuel injection system in its assembled state can thus be put into a neutral, force-free position, since positional and tolerance compensation is possible. As a result, injection valves that in particular are long in the axial direction X-X as well can be constructed, which because of their lever arm often exert a strong force on the fuel distributor line. The separate bracing ring 10 always ensures bracing of the fuel injection valve 3 on the cylinder head 5 in the axial direction X-X.

Figure 3:
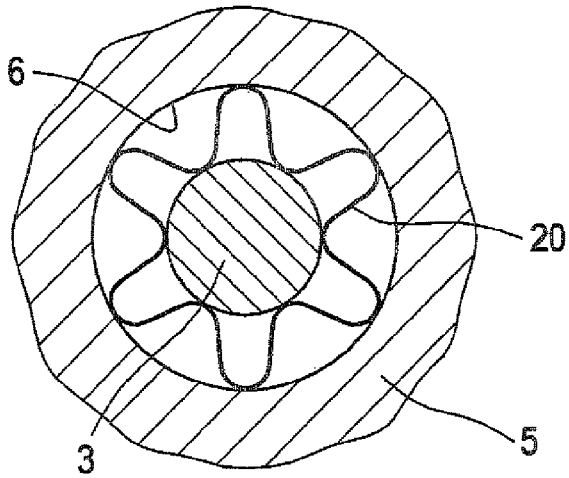
FIG. 3 is a schematic sectional view of a fuel injection system in a second exemplary embodiment of the invention.

Below, with reference to FIG. 3, a fuel injection system in a second exemplary embodiment of the invention will be described in detail. Identical or functionally identical parts are identified by the same reference numerals as in the first exemplary embodiment.

The difference between the fuel injection system of the second exemplary embodiment resides in a different compensation element. As can be seen from FIG. 3, a wave ring 20 is provided as the compensation element in the second exemplary embodiment. The wave ring has a sinusoidal, ringlike curve form, with bracing regions formed alternatingly radially outward and radially inward. As a result, the wave ring 20 provides bracing between the fuel injection valve 3 and the receiving bore 6 in the cylinder head 5. Otherwise, its function is equivalent to that of the compensation element 9 of the first exemplary embodiment, so that the description given there can be referred to.

Figure 4:
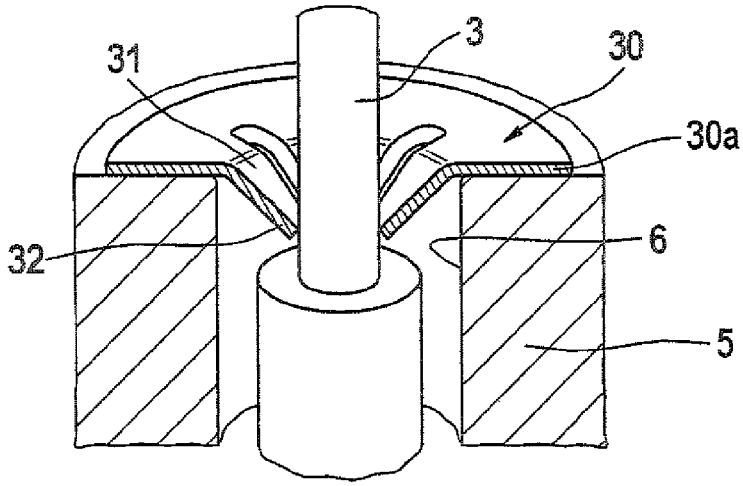
FIG. 4 is a schematic sectional view of a fuel injection system in a third exemplary embodiment of the invention.

FIG. 4 shows a fuel injection system in a third exemplary embodiment, with a further alternative for a compensation element. The compensation element of the third exemplary embodiment is a disk 30 with a disk region 30*a* and a collar 31 formed in one piece on it. The collar 31 is disposed centrally in the disk 30 and is secured to the fuel injection valve 3, for instance by means of clamps. The disk 30 is placed on the surface of the cylinder head 5, and a connection region 32 protrudes partway into the receiving bore 6 in the cylinder head 5. This connection region 32 between the disk region 30*a* and the collar 31 makes the requisite compensation motions possible and therefore has a predetermined elasticity. The compensation element of the third exemplary embodiment may be made from plastic or from a metal material. Otherwise, this exemplary embodiment corresponds to the foregoing exemplary embodiments, so that the description given there can be referred to.

Figure 5:
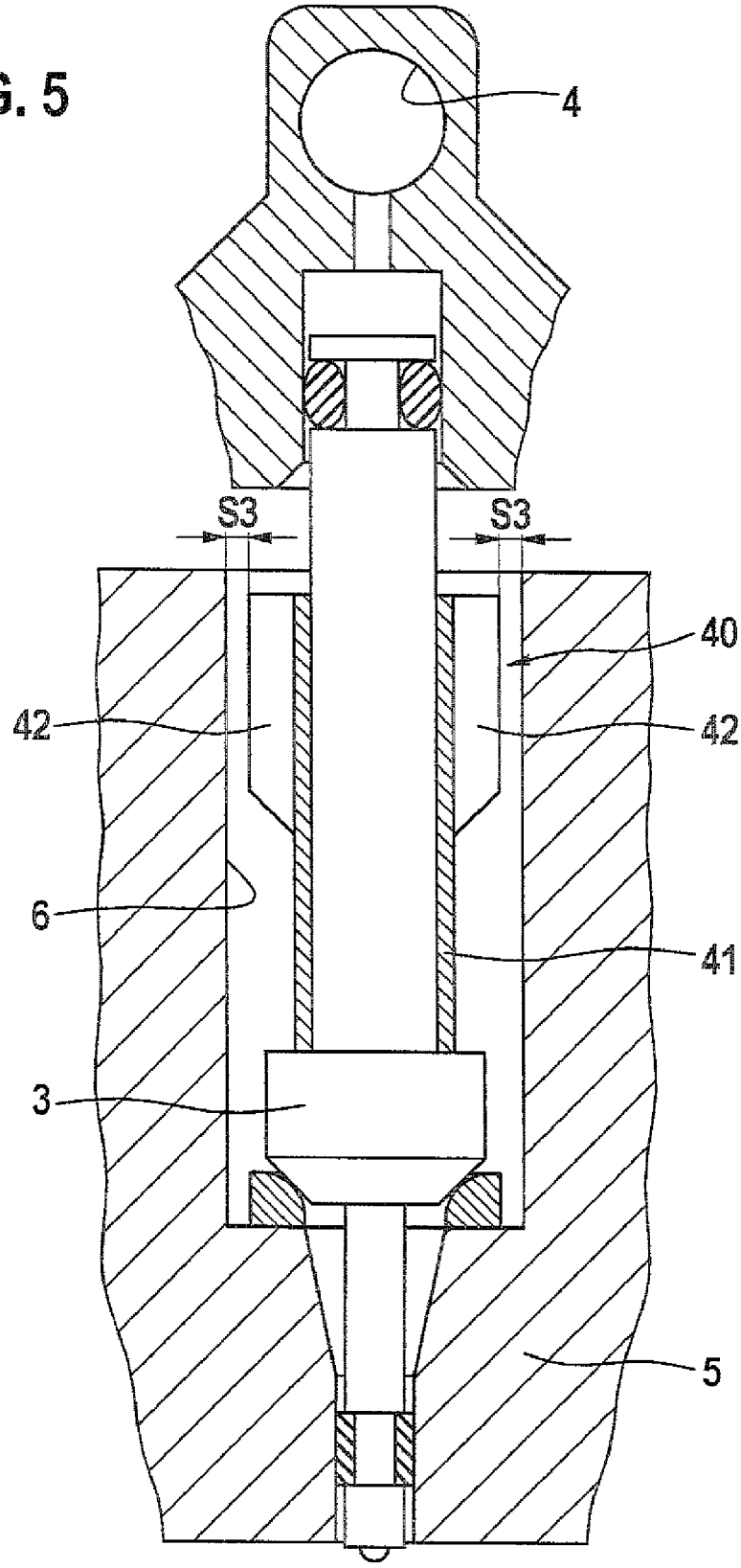
FIG. 5 is a schematic sectional view of a fuel injection system in a fourth exemplary embodiment of the invention.

FIG. 5 shows a fuel injection system 1 in a fourth exemplary embodiment of the present invention, in which identical or functionally identical parts are identified by the same reference numerals as in the foregoing exemplary embodiments.

As can be seen from FIG. 5, the fuel injection system of the fourth exemplary embodiment is essentially equivalent to that of the first exemplary embodiment, and the compensation element for the positional compensation and/or tolerance compensation is a rib assembly 40. The rib assembly 40 includes a cylindrical base region 41 as well as a plurality of ribs 42. The rib assembly 40 is secured to the fuel injection valve 3 in such a way that the ribs 42 point in the direction of the fuel distributor line 4. The ribs 42 have a certain elasticity. As can be seen from FIG. 5, a play S3 is provided between the ribs 42 and the receiving bore 6 in the cylinder head 5. As a result of this play S3, upon a tolerance compensation one or more of the ribs 42 are not immediately deformed; instead, this play S3 has to be overcome first, before one or more ribs 42 come into contact with the receiving bore 6, after which a deformation and force absorption occurs because of the differences in tolerance. Otherwise, this exemplary embodiment is equivalent to the foregoing exemplary embodiments, so that the description given there can be referred to.

The foregoing relates to the preferred exemplary embodiments of the invention, it being understood that other variants and embodiments thereof are possible within the spirit and scope of the invention, the latter being defined by the appended claims.

The invention claimed is:

1. A fuel injection system for direct injection of fuel into a combustion chamber of an internal combustion engine, comprising:

at least one fuel injection valve, a cylinder head having at least one receiving bore defining a first section and a second section demarcated by an annular step, said at least one fuel injection valve disposed in said first and second sections of at least said one receiving bore, in order to inject fuel into the combustion chamber;

a fuel distributor line, for delivering the fuel to the fuel injection valve;

a compensation element for positional compensation and/or tolerance compensation, which is disposed in the radial direction between the fuel injection valve and the cylinder head in contact relation with said fuel injection valve and said first section of said receiving bore, and which is disposed in an axial direction of the fuel injection valve between a first sealing element, which seals at a side of the fuel injection valve oriented toward the combustion chamber between the fuel injection valve and the cylinder head, and a second sealing element, which seals between the fuel injection valve and the fuel distributor line; and a bracing ring, which is disposed between the fuel injection valve and the cylinder head about said step and furnishes bracing of the fuel injection valve in the axial direction at said step of the receiving bore, said bracing ring having a smaller diameter than said first section of said bore to provide play therebetween in the radial direction.

2. The fuel injection system as defined by claim 1, wherein the first sealing element is a Teflon ring.

3. The fuel injection system as defined by claim 1, further including a fixation element, in particular a distributor line cup, for securing the fuel distributor line with play to the cylinder head.

4. The fuel injection system as defined by claim 1, wherein the compensation element includes a sleeve with a fixation region and a plurality of elastic elements.

5. The fuel injection system as defined by claim 4, wherein the elastic elements are embodied as at least three radially outward-protruding hooks or lugs.

6. The fuel injection system as defined by claim 4, wherein the compensation element is made from plastic or from a sheet-metal material, in particular a spring sheet metal.

7. The fuel injection system as defined by claim 5, further including a fixation element, in particular a distributor line cup, for securing the fuel distributor line with play to the cylinder head.

8. The fuel injection system as defined by claim 5, wherein the first sealing element is a Teflon ring.

9. The fuel injection system as defined by claim 1, wherein the compensation element includes a wave ring.

10. The fuel injection system as defined by claim 9, wherein the compensation element is disposed directly at a beginning of the receiving bore.

11. The fuel injection system as defined by claim 9, wherein the compensation element is made from plastic or from a sheet-metal material, in particular a spring sheet metal.

12. The fuel injection system as defined by claim 1, wherein the compensation element includes a disk element, with a disk region and a collar disposed in the receiving bore in the cylinder head, and the collar is connected to the disk region of the disk element via a connection region, and the connection region has a predetermined elasticity.

13. The fuel injection system as defined by claim 12, wherein the compensation element is made from plastic or from a sheet-metal material, in particular a spring sheet metal.

14. The fuel injection system as defined by claim 12, wherein the compensation element is disposed directly at a beginning of the receiving bore.

15. The fuel injection system as defined by claim 1, wherein the compensation element includes a rib assembly, having a plurality of elastic ribs in the axial direction of the fuel injection valve, and the ribs are disposed between the fuel injection valve and the cylinder head.

16. The fuel injection system as defined by claim 15, wherein the compensation element is made from plastic or from a sheet-metal material, in particular a spring sheet metal.

17. The fuel injection system as defined by claim 15, wherein the ribs are integrally injection-molded onto the fuel injection valve and/or onto the receiving bore.

18. The fuel injection system as defined by claim 15, wherein the ribs are disposed on the fuel injection valve, and a play is provided between the ribs and the cylinder head.

19. The fuel injection system as defined by claim 15, wherein the compensation element is disposed directly at a beginning of the receiving bore.

20. The fuel injection system as defined by claim 4, wherein the compensation element is disposed directly at a beginning of the receiving bore.

* * * * *